United States Patent [19]

Hertrich

[11] Patent Number: 4,916,991

[45] Date of Patent: Apr. 17, 1990

[54] DEVICE FOR PUNCHING AND LONGITUDINAL CUTTING OF A WEB PROCESSED IN A ROTARY FOLDER

[75] Inventor: Klaus Hertrich, Göhrenz, German Democratic Rep.

[73] Assignee: VCB Kombinat Polygraph Werner Lamberg, Fed. Rep. of Germany

[21] Appl. No.: 67,225

[22] Filed: Jun. 25, 1987

[30] Foreign Application Priority Data

Aug. 27, 1986 [DD] German Democratic Rep. ... 293881

[51] Int. Cl.[4] ..... B26D 1/22

[52] U.S. Cl. ..... 83/302; 83/345; 83/482; 83/503; 83/506; 83/508.3

[58] Field of Search ..... 83/302, 482, 503, 506, 83/345, 508.3

[56] References Cited

U.S. PATENT DOCUMENTS

| | | | |
|---|---|---|---|
| 1,051,803 | 1/1913 | Cardell | 83/302 |
| 1,663,788 | 3/1928 | Zimniewicz | 83/482 X |
| 2,324,950 | 7/1943 | Pratt | 83/302 X |
| 3,257,887 | 6/1966 | Jones | 83/503 |
| 3,332,326 | 7/1967 | Haas | 83/482 X |
| 3,364,803 | 1/1968 | Senftleben | 83/503 |
| 3,570,335 | 3/1971 | Marin | 83/9 |
| 3,603,190 | 9/1971 | Kollen | 83/499 |
| 3,641,853 | 2/1972 | Jungbeck | 83/7 |
| 3,956,957 | 5/1976 | Corse | 83/482 |

*Primary Examiner*—Donald R. Schran
*Assistant Examiner*—Eugenia A. Jones

[57] ABSTRACT

A punching and longitudinal cutting device for rotary folders includes two pairs of opposite web feeding rollers fixedly arranged on shafts. One shaft in a first pair carries an edge trimming blade and a punching or perforating blade and is adjustable in radial direction relative to the other shaft by means of cams controlled by a control shaft. The angular position of the cams is adjustable so that the one shaft can be adjusted either in parallel or in an inclined position relative to the other shaft. The other shaft is axially adjustable relative to the frame. The other shaft supports a counter blade cooperating with the edge cutting blade, a counter roll and a carrier for supporting two coplanar counter rolls cooperating with the punching or perforating blade. The coplanar counter rolls are axially displaceable on the carrier and held in a fixed position relative to the frame.

4 Claims, 5 Drawing Sheets

DEVICE FOR PUNCHING AND LONGITUDINAL CUTTING OF A WEB PROCESSED IN A ROTARY FOLDER

BACKGROUND OF THE INVENTION

The present invention relates in general to rotary printing machines and in particular to a punching and longitudinal cutting device for use in a rotary folder of a printing machine. Punching and longitudinal cutting devices of this kind serve with advantage for performing perforations, punch outs and edge trimming of a web of material are provided preferably between the longitudinal folder and the transverse folding aggregate, that means before the cross cutter. In completed printed products such as for example in advertisement printed matter, it is frequently desired to make such perforations, punch outs and edge trimming in a diversified manner.

In known punching and longitudinal cutting devices, a separate pair of rollers is provided for the respective working stations such as punching, longitudinal cutting and perforating stations because the punching or perforating blade must be set in alignment with its counter blade, whereas edge trimming and other longitudinal cutting blades apart from the aligned setting must be also adjustable axially, for example for producing a requisite bias.

For instance, DE-PS 31 51 283 shows a series of feeding and guiding rolls arranged before the respective punching blade rollers. According to DE-OS 33 05 760 there are also arranged paper feeding and tensioning rollers before the two pairs of rollers for the longitudinal and transverse perforation. With the known devices, however, it is not possible to accommodate in a space saving manner the punching and longitudinal cutting device on the two pairs of feeding rolls.

SUMMARY OF THE INVENTION

It is, therefore, an object of this invention to overcome the disadvantage of the prior art punching and longitudinal cutting devices. In particular, it is an object of this invention to arrange such a device on the two pairs of feed rollers, which normally are present in a rotary folder. Another object of this invention is to save component parts and reduce the height of the folder. Still another object of this invention is to provide such an improved punching and longitudinal cutting device which is simple in structure and in the feeding direction of the web punches rectangular cutouts in register with a predetermined folding line and simultaneously performs an edge trimming cut for example.

In keeping with these objects and others which will become apparent hereafter, one feature of this invention resides in supporting the pairs of feed rollers on two shafts of which one is adjustable in radial direction so as to vary its spacing relative to the other shaft and the other shaft is adjustable in axial direction relative to a supporting frame. The first shaft in addition to the feed rolls also supports an edge trimming blade and a punching blade roll for producing punch outs in the direction of a folding line. In order to set the distance between two shafts, the first mentioned shaft is supported for rotation in bearings attached to the ends of two connecting rods which are slideably supported in the frame and spring biased against cams mounted on a control shaft. The mutual position of the cams on the control shaft is adjustable so as to obtain either a parallel or an inclined mutual position of the two shafts. The second shaft is axially adjustable in the frame and supports, apart from the opposite feed rolls, a counter roll assembly which cooperates with the punching blade roll. The counter roll assembly including a counter roll and a carrier which supports for rotation two coplanar counter rolls of smaller diameter. The carrier is fixedly mounted on the second shaft and the coplanar counter rolls are shiftable relative to the second shaft and are held in a fixed position relative to the frame by a holding prong. An additional edge trimming blade roll is arranged on the second shaft. In the second pair of feed rolls, the corresponding first shaft is supported on the frame in self-aligning bearings and the radial position of one of the bearings relative to the second shaft is adjustable by means of an eccentric plate.

The novel features which are considered as characteristic for the invention are set forth in the appended claims. The invention itself, both as to its construction and its method of operation, will be best understood from the following description of specific embodiments when read in connection with the accompanying drawing.

DESCRIPTION OF THE PREFERRED EMBODIMENT

Figure 1:
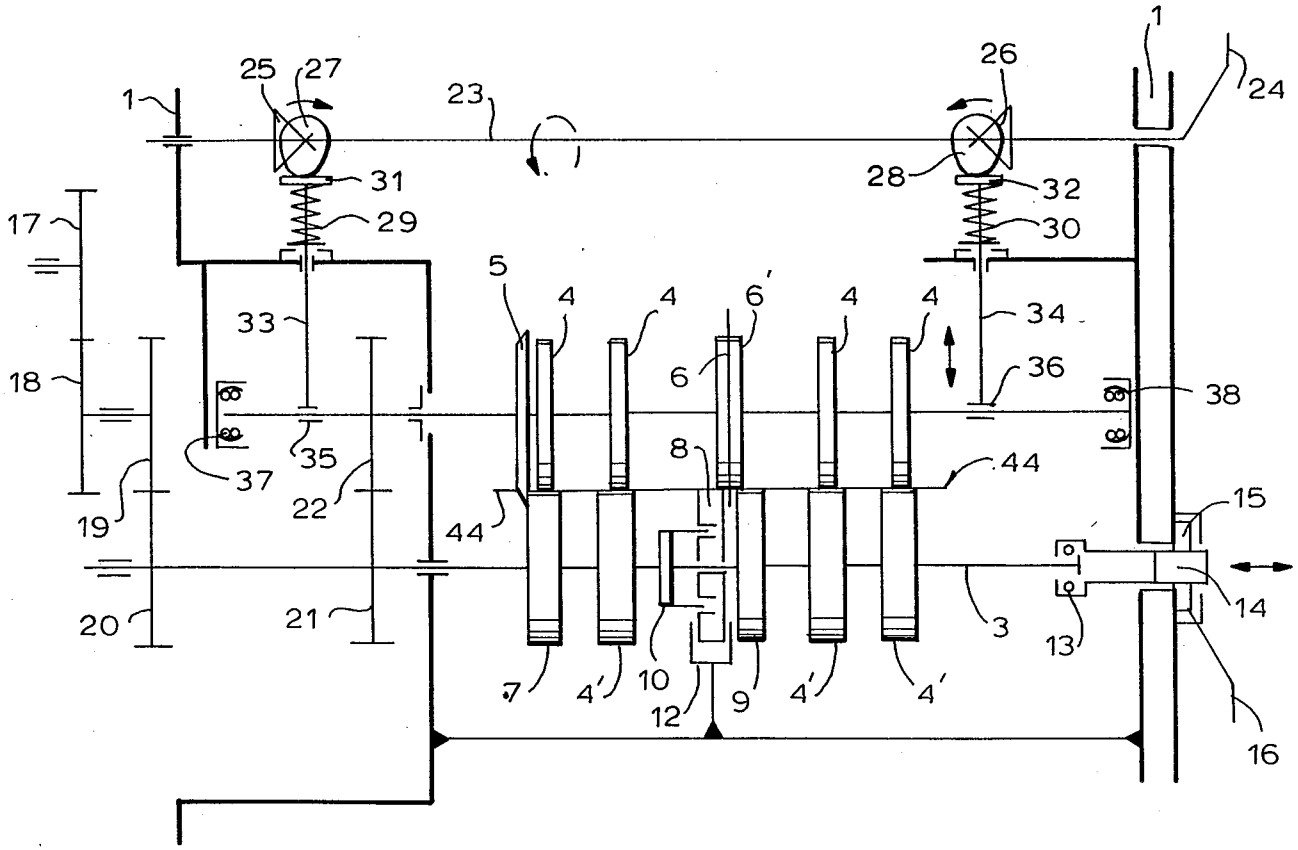
FIG. 1 is a schematic top view of the upper pair of feed rollers and the device of this invention, shown in its working position.
Figure 2:
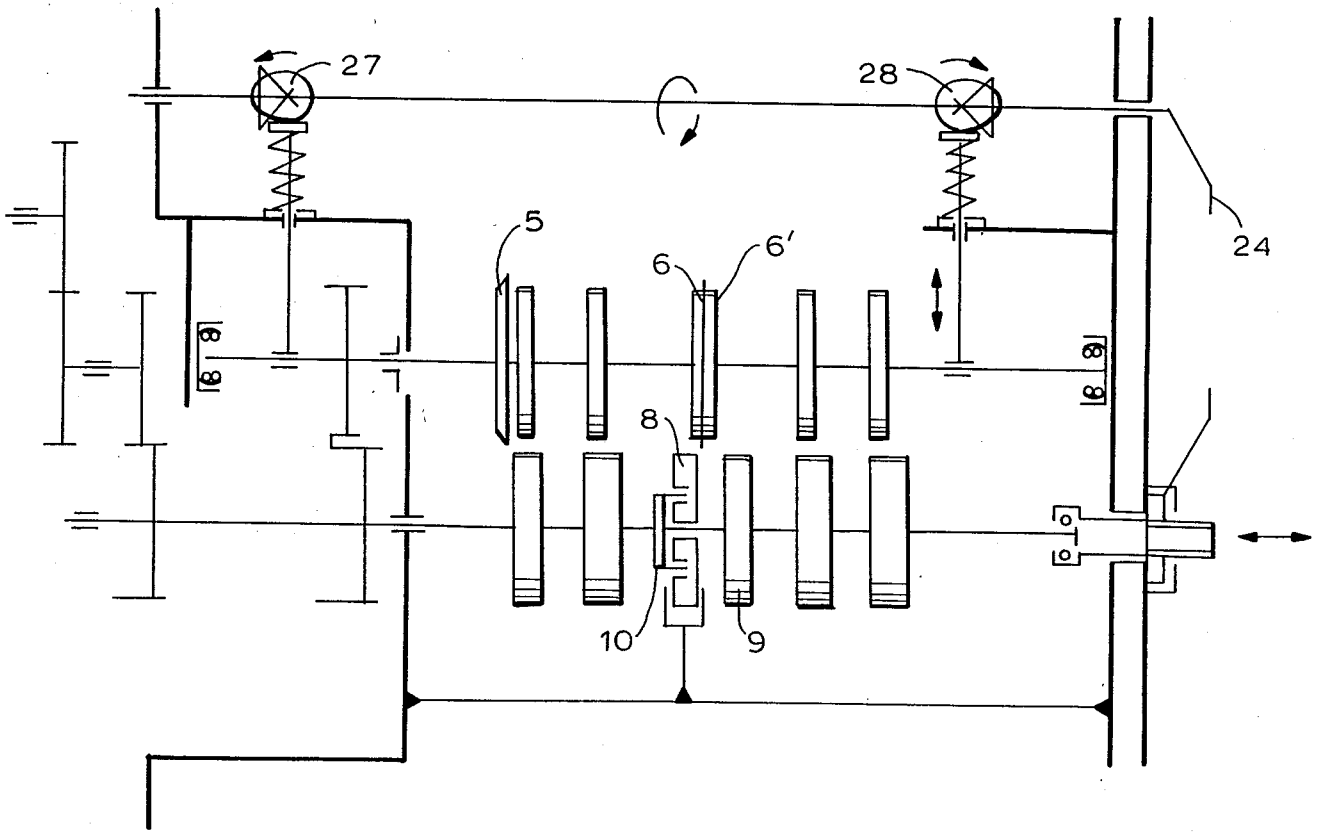
FIG. 2 shows the device of FIG. 1 in its disengaged position.
Figure 5:
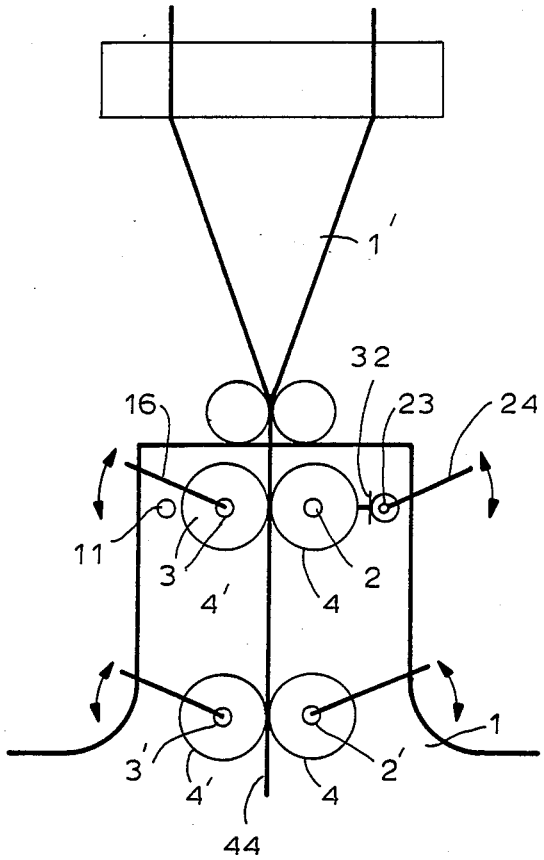
FIG. 5 is a schematic side view of a part of a rotary folder including the upper and the lower pair of feed rollers shown with the processed web.

Referring firstly to FIG. 5, frame 1 of a non-illustrated rotary folder supports for rotation shafts 2 and 3 of an upper pair of feed rollers each assembled of a set of feed rolls. The upper pair of feed rollers is arranged after a funnel 1' for guiding a processed web of material 44. As shown in FIGS. 1 and 2, a first set of feed rolls 4 together with an edge trimming blade 5 and with a feed roll 6' supporting a punching or perforating blade 6 are fixedly mounted on the shaft 2. The second set of feed rolls 4' which slightly exceed in width the first set, is fixedly mounted on the second shaft 3 together with a counter blade 7 which cooperates with the edge trimming blade 5, and with a carrier 10 supporting for rotation two coplanar counter rolls 8 of smaller diameter, and another counter roll 9 of the same diameter as the feed rolls, are fixedly connected to the shaft 3. In contrast to the feed rolls 4' and the counter roll 9, the coplanar counter rolls 8 are not fixed in position relative to the shaft 3 but are shiftable in axial direction on the carrier 10. A transom or cross beam 11 fixedly attached to the frame 1 supports a holding prong 12 which holds the coplanar counter rolls 8 in a fixed position relative to the frame even if the shaft 3 is axially displaced. The axial displacement of the shaft 3 is affected by means of a threaded piece 14 loosely passing through the frame 1 and supporting at the inner end thereof a bearing 13 for the shaft 3. The outer threaded end of the piece 14 engages a setting nut 15 provided with a handle 16 by means of which the axial position of the shaft 3 relative to the frame is adjusted.

The shaft 3 is driven via spur gears 17, 18, 19, 20 by a non-illustrated machine drive. Further spur gears 21, 22 transfer movement of the shaft 3 to the shaft 2. The pair of meshing spur gears 21 and 22 are preferably made with a large module so that the teeth of the two gears remain in engagement even after the shafts 2 and 3 have been moved in radial direction one from the other. Frame 1 further supports for rotation a control shaft 23 provided with a handle 24. The rotation of control shaft 23 imparted by the handle 24 is transmitted via bevel gears 25 and 26 on two cam disks 27 and 28. The cams 27 and 28 engage end surfaces 31 and 32 of connecting rods 33 and 34 which are guided in the frame and spring biased by springs 29 and 30 against the assigned cams. The opposite ends of connecting rods are provided with bearings 35 and 36 which support for rotation the shaft 2. In addition, the ends of the shaft 2 are supported in self-aligning or swing bearings 37 and 38 which are shiftable in the frame 1 at right angles to the shaft 3. The angular position of the cam disks 27 and 28 relative to the bevel gears 25 and 26 is adjustable and lockable in a known manner so that it is possible to displace the shaft 2 relative to the shaft 3 either in parallel or in an inclined position. The adjustability of the cams 27 and 28 makes it possible to correct any misalignment of the two shafts 2 and 3 or to eliminate during a partial rotation of the control shaft 23 the controlling effect of a cam on the displacement of the shaft 2 relative to the shaft 3. In this manner, for example when the punching or perforating elements 6, 8 and 9 are disengaged, a swinging movement can be imparted to the shaft 2 by one of the cams.

Figure 3:
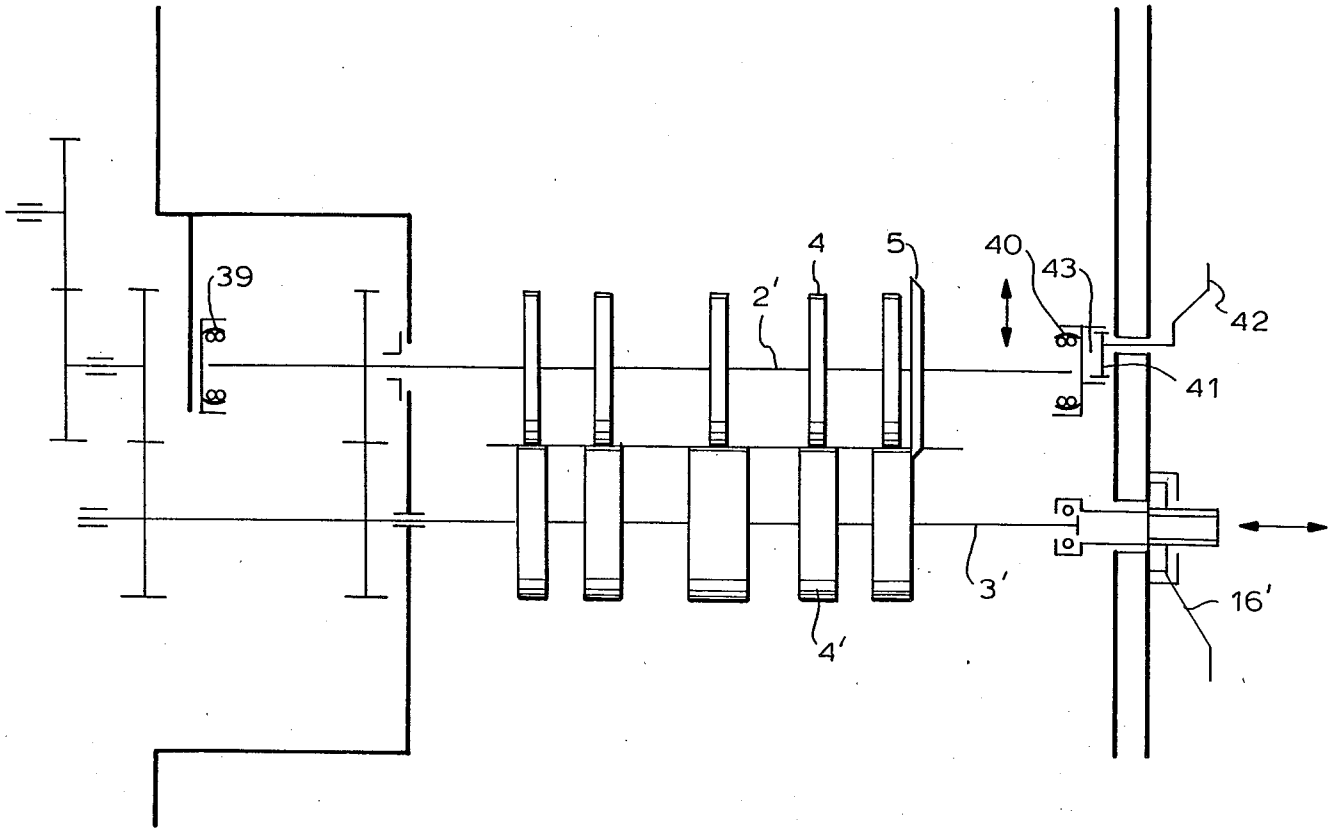
FIG. 3 is a top view of the lower pair of feed rollers of the device of FIG. 1, shown in its working position.
Figure 4:
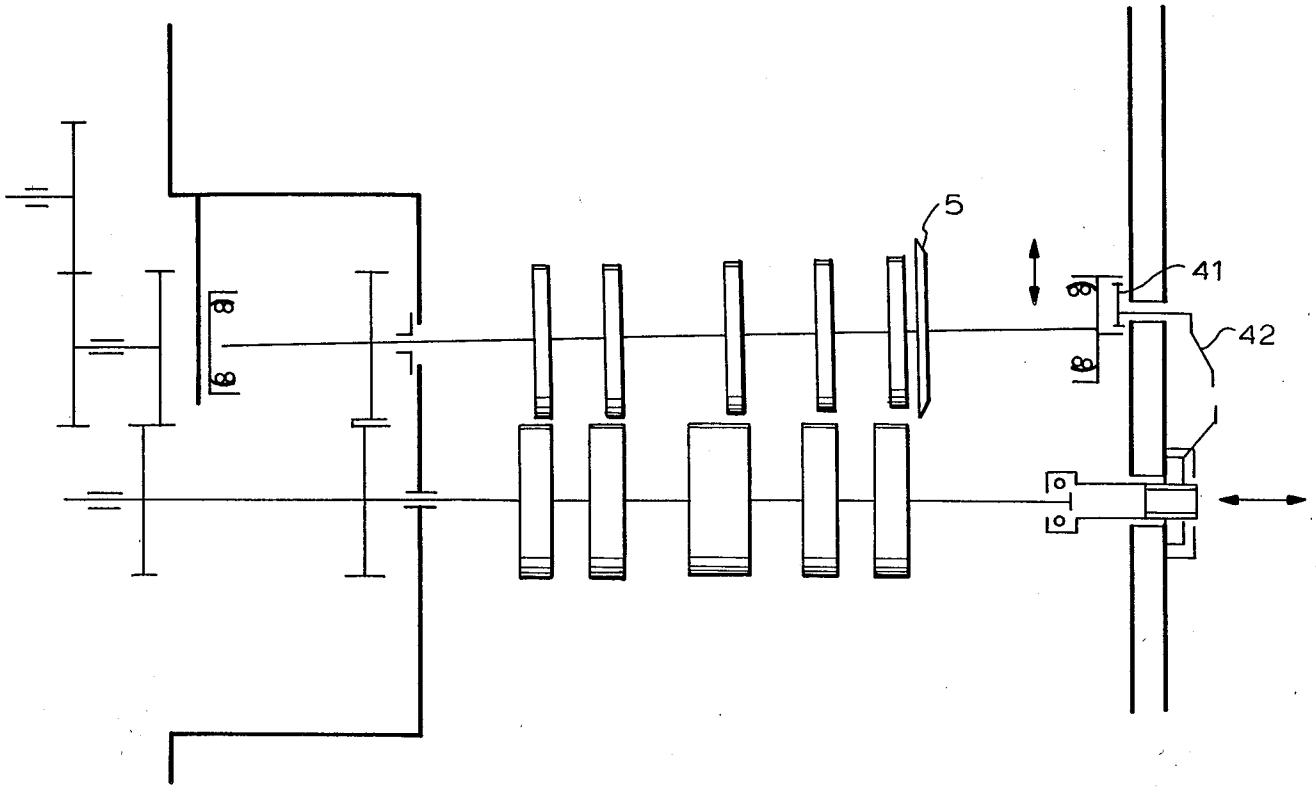
FIG. 4 shows the feed rollers of FIG. 3 in the disengaged position.

In FIGS. 3 and 4, there is illustrated the second or lower pair of feed rollers on which a further edge trimming blade 5 is arranged. The shaft 3' corresponds in design to the shaft 3 in the upper pair of feed rollers. The corresponding shaft 2', however, is supported for rotation in the self-alignment bearings 39 and 40. An eccentric 41 rotatable by means of a control lever 42 engages a recess 43 in the swinging or self-aligning bearing 40 so that by rotating the eccentric the shaft 2' is adjustable at one side thereof into an inclined position relative to the second shaft 3'. Of course, instead of control levers 16' and 42, the individual shafts 2, 3, and 23 can be moved by actuation cylinders.

During drawing of a material web 44 into the folder, both pairs of feed rollers are in disengaged positions illustrated in FIGS. 2 and 4. In order to set the feed rollers together with the punching and cutting device of this invention into their working positions, the control shaft 23 is rotated until the cam disks 27 and 28 are brought into an angular position shown in FIG. 1. In this position, edge trimming blade 5 and punching or perforating blade 6 which projects at the center plane of the feed roll 6' penetrate the web material 44 and the feed rolls 4 and 6' on shaft 2 press the web 44 against the counter blade 7, opposite feed rolls 4' and counter rolls 8, 9 on shaft 3. Thereafter the axial position of the shaft 3 is finely adjusted by means of the handle 16 to the left until counter blade 7 engages the edge trimming blade 5 and the counter rolls 8 and form a narrow gaps on both sides of the punching or perforating blade 6. In the same manner, the lower pair of feed rollers is brought into engagement by means of control lever 42 and the shaft 2' is brought into an engaged position shown in FIG. 3. Thereafter, the shaft 3' is finely adjusted in axial direction by means of handle 16'.

While the invention has been illustrated and described as embodied in a rotary folder having two pairs of paper feed rollers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Device for perforating and longitudinal cutting a web processed in a rotary folder, comprising a frame supporting for rotation two pairs of web feeding rollers, each of said feeding rollers including a set of feed rolls fixedly arranged in a spaced relation one to another on a shaft; an edge trimming blade and a perforating blade fixedly arranged on one shaft in a first pair; a counter blade and a counter roll assembly arranged on the other shaft of said first pair and cooperating, respectively, with said edge trimming blade and said perforating blade; said counter roll assembly including a carrier secured to said other shaft and supporting for rotation axially shiftable coplanar counter rolls, means attached to said frame for holding said coplanar counter rolls a small distance from one side of said perforating blade, and a counter roll secured to said other shaft opposite the other side of said perforating blade; means arranged on said frame for adjusting in each of said pairs the spacing of said one shaft relative to the other shaft; and means arranged on said frame for adjusting axial position of said other shaft relative to said one shaft to finely adjust the working position of said counter blade and said counter roll assembly.

2. Device as defined in claim 1, wherein said spacing adjusting means includes a control shaft supported for rotation in said frame, cams controlled by said control shaft, spring biased connecting rods movably supported on said frame and each engaging at one end thereof an assigned cam, bearings provided at the other ends of respective connecting rods to support for rotation said one shaft in the first pair of feeding rollers.

3. Device as defined in claim 2, wherein said control shaft supports means for rotating said cams into predetermined positions to adjust said one shaft in the first pair either in parallel or in an inclined position relative to said other shaft.

4. Device as defined in claim 2, wherein one of the shafts in said second pair of web feeding rollers is supported for rotation in self-aligning bearings; and further comprising an eccentric for adjusting the position of one of said self-aligning bearings relative to said frame.

* * * * *